United States Patent [19]

Hunter

[11] 3,949,832

[45] Apr. 13, 1976

[54] PORTABLE FIRE ESCAPE

[76] Inventor: Cloyce R. Hunter, 492 Topaz Ave., Mansfield, Ohio 44907

[22] Filed: Dec. 4, 1974

[21] Appl. No.: 529,589

[52] U.S. Cl. ..... 182/7; 188/65.2; 188/65.4

[51] Int. Cl.[2] ..... A62B 1/14

[58] Field of Search ..... 182/5, 6, 7, 3; 188/65.2, 188/65.4, 65.5

[56] References Cited

UNITED STATES PATENTS

| | | | |
|---|---|---|---|
| 1,021,361 | 3/1912 | Elliott | 188/65.4 |
| 1,187,754 | 6/1916 | Lyra | 188/65.5 |
| 1,497,534 | 6/1924 | Bass | 188/65.4 |
| 3,335,469 | 8/1967 | Shand | 182/5 |

*Primary Examiner*—Reinaldo P. Machado
*Attorney, Agent, or Firm*—Clarence A. O'Brien; Harvey B. Jacobson

[57] ABSTRACT

An elongated flexible tension member is provided including a first end attachable to an upper floor portion of a building and a free end portion which may depend downwardly to ground level. A slide member is engaged with the tension member for guided movement therealong and defines a handgrip to be held by a user moving downwardly along the tension member with the slide. The slide further supports a seat portion therebelow upon which the user may be seated while grasping the handgrip defining slide and moving downwardly therewith. Also, the slide includes readily actuatable and deactuatable friction brake and clamping structure for selectively and variably braking the descent of the slide and seat portion supported therefrom along the tension member.

10 Claims, 7 Drawing Figures

PORTABLE FIRE ESCAPE

BACKGROUND OF THE INVENTION

There are many instances when it is desirable, especially in the case of a fire, for persons to be provided with means for escape from upper floors of a building on the exterior thereof. Variously constructed apparatus have been heretofore designed for use in conjunction with elongated flexible tension members to allow persons to enjoy a reasonably controlled descent on the exterior of a building in the case of a fire or other emergency. Examples of previously patented devices of this type are disclosed in U.S. Pat. Nos. 219,511, 340,573, 439,263, 2,544,964 and 2,561,832. However, these previously patented devices are in some instances not wholly operable in the desired manner.

SUMMARY OF THE INVENTION

The portable fire escape of the instant invention utilizes an elongated flexible tension member having a first end which may be attached to the exterior of an upper floor portion of a building from which escape is desired. A guide structure is mounted on the elongated tension member for movement therealong and includes readily actuatable and deactuatable friction brake and clamping structure for selectively and variably braking movement of the guide structure along the tension member. The guide structure constitutes an elongated body member extending along the associated tension member and the aforementioned friction brake and clamping structure includes independently operable portions at opposite ends of the body and operable when the body is in relatively inverted upstanding position. The friction brake and clamping structure at opposite ends of the body are yieldingly biased to the deactuated positions thereof and accordingly, only one of the friction brake and clamping structures needs to be actuated for controlled descent of the body along the tension member. Also, each of the friction brake and clamping structures carried by the opposite ends of the body is operable in a partially self-energizing manner when the corresponding end of the body is advanced along the associated tension member.

The main object of this invention is to provide a portable fire escape which may be utilized by even inexperienced persons to effect escape from the upper floors of a building in the case of an emergency.

A further object of this invention, in accordance with the immediately preceding object, is to provide a fire escape constructed in a manner whereby it may be readily stored in a compact state for ready usage within an outside room of an upper floor of any building.

A still further object of this invention is to provide a fire escape of the portable type and in accordance with the preceding objects constructed in a manner whereby it may be repeatedly used during the same emergency and means is provided to elevate the user supporting portion thereof back up to an upper floor of the associated building once the user supporting portion thereof has been utilized to lower the initial user to the ground.

A final object of this invention to be specifically enumerated herein is to provide a portable fire escape in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Referring now more specifically to the drawings, the numeral 10 generally designates a multifloor building and the numeral 12 designates the window of an upper floor of the building while the numeral 14 designates a window on the ground floor of the building 10.

Figure 1:
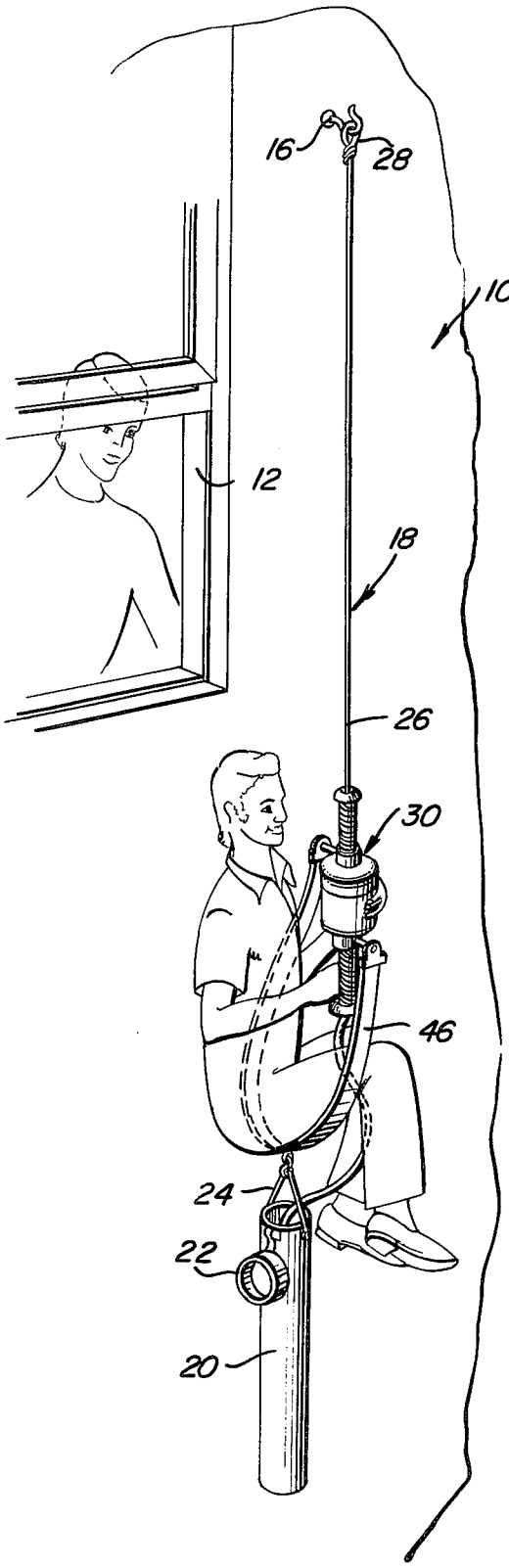
FIG. 1 is a fragmentary perspective view of the exterior portion of an upper floor of a building with the portable fire escape of the instant invention illustrated as placed in initial use.
Figure 2:
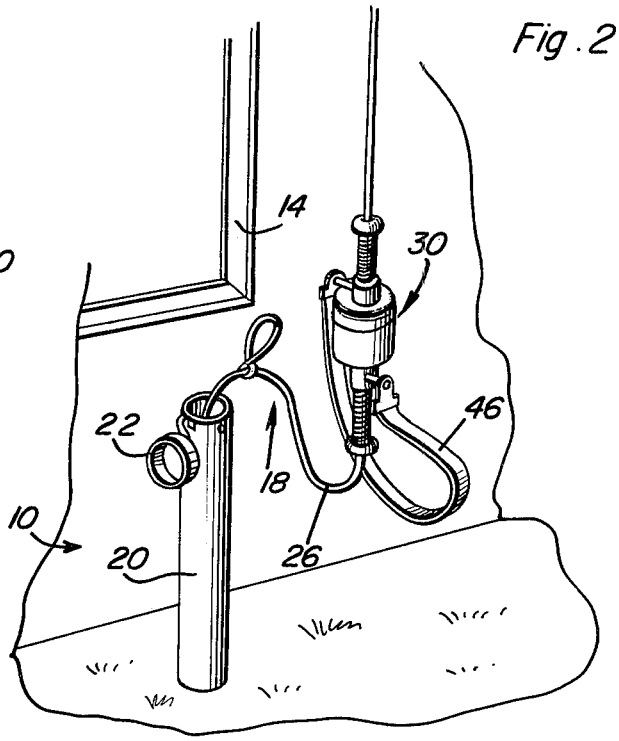
FIG. 2 is a fragmentary perspective view of the ground level of a building with the portable fire escape illustrated after having initially been used to lower a person to ground level.
Figure 3:
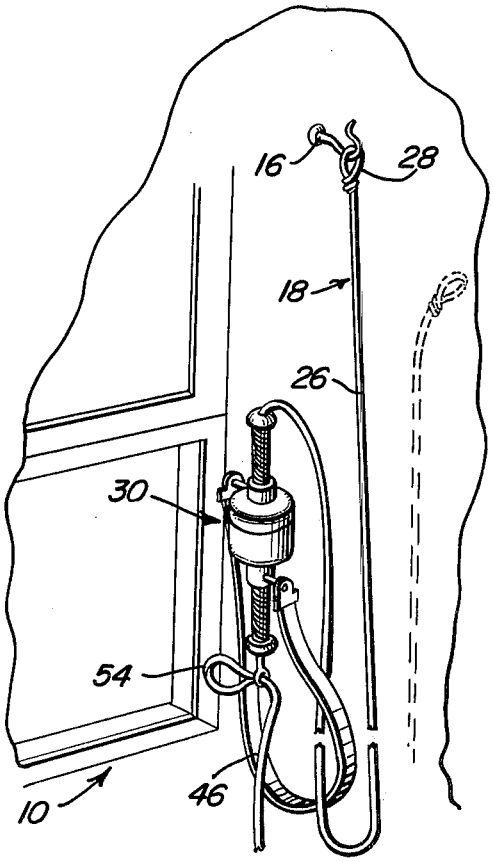
FIG. 3 is a fragmentary perspective view illustrating the manner in which the user supporting portion of the fire escape may be inverted in order to allow the controlled descent of a subsequent user of the fire escape.

The exterior wall of the building 10 has a supportive hook 16 anchored thereto adjacent the window opening 12 and the portable fire escape of the instant invention is generally designated by the reference numeral 18 and illustrated in FIG. 1 of the drawings as operatively associated with the hook 16.

The fire escape 18 includes a cylindrical canister 20 provided with a removable closure 22 and a flexible bail-type handle 24. The canister 20 comprises a container in which a length of elongated flexible tension member 26 may be stored in a neat and coiled condition for ready withdrawal from the canister 20. One end of the tension member 26 includes an eye 28 removably engageable over the hook 16 and a support body referred to in general by the reference numeral 30 is mounted on the tension member 26 for guided movement therealong.

Figure 4:
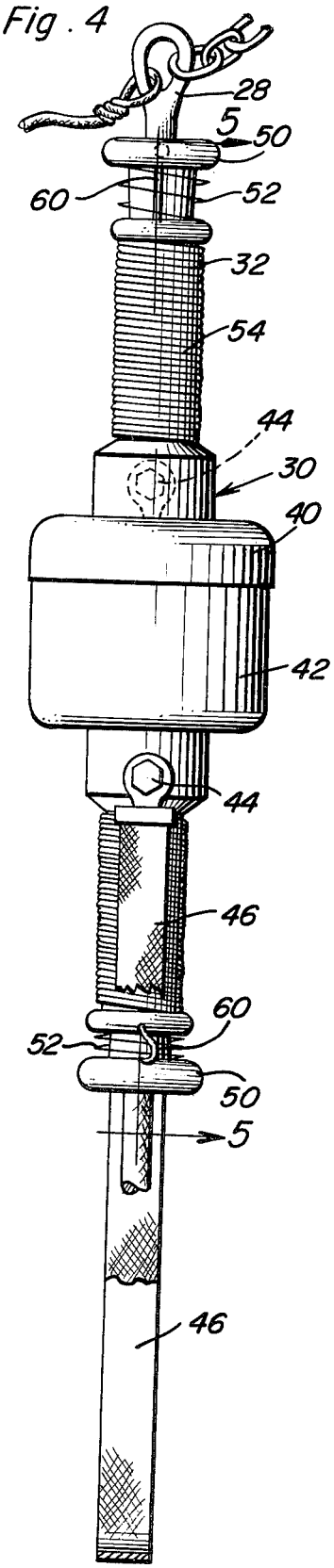
FIG. 4 is an enlarged elevational view of the user supporting portion of the fire escape.
Figure 6:
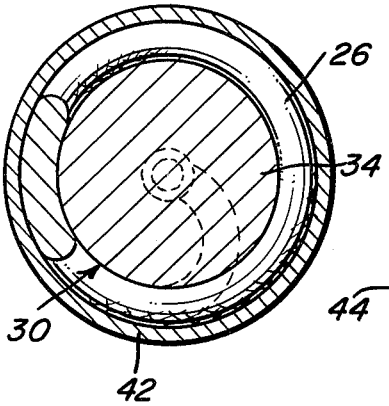
FIG. 6 is an enlarged horizontal sectional view taken substantially upon the plane indicated by the section line 6—6 of FIG. 5.
Figure 5:
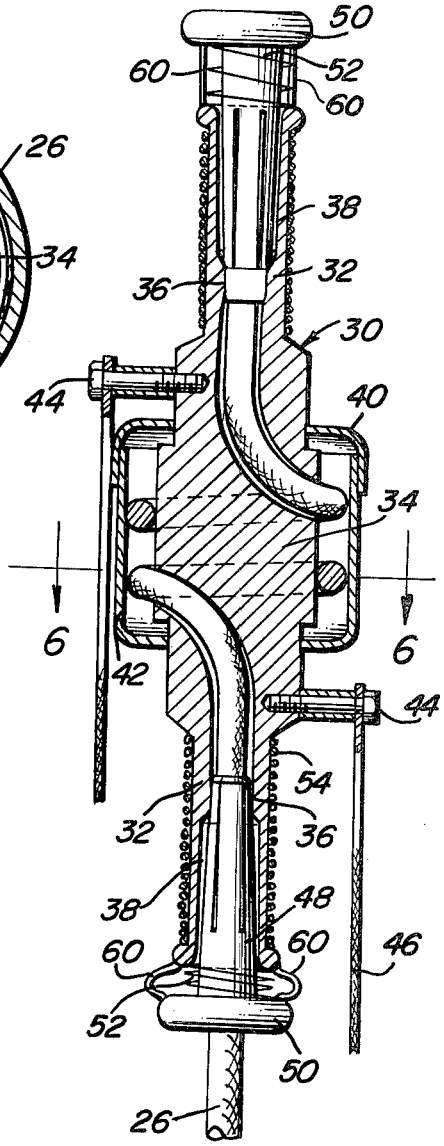
FIG. 5 is a diminished vertical sectional view taken substantially upon the plane indicated by the section line 5—5 of FIG. 4.
Figure 7:
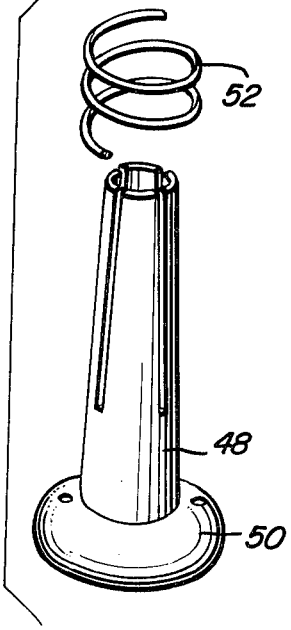
FIG. 7 is an exploded perspective view of one of the selectively actuatable friction brake and clamping structures of the user supporting portion of the fire escape.

As may best be seen from FIGS. 4 through 6 of the drawings, the body 30 includes a pair of diametrically reduced opposite end portions 32 and a larger diameter central portion 34. The terminal ends of the opposite end portions 32 have central longitudinal bores 36 formed therein and the outer end of each bore 36 includes a slightly outwardly flared counterbore 38. The inner ends of the bores 36 curve gradually outwardly from the longitudinal center axis of the body 30 and in opposite directions about the center axis and open through axially spaced portions of the center portion 34 of the body 30 in directions extending in opposite directions generally peripherally about the center portion 34. The tension member 26 extends through the bores 36 and is circled somewhat less than twice around the center portion 34 of the body 30 on the exterior thereof, the center portion 34 of the body 30 including telescopingly engaged cup portions 40 and 42 thereon enclosing those portions of the tension member 26 extending about the center portion 34 between the adjacent inner ends of the bores 36 which open through the outer peripheral surfaces of the center portion 34.

Opposite end portions of the center portion 34 of the body 30 include oppositely radially outwardly projecting anchor fasteners 44 to which the opposite ends of a sling seat 46 are secured, the bail type handle 24 of the canister 20 being anchored to and slidable along the center portion of the sling type seat 46.

The counterbores 38 each have tapered split collet sleeves 48 received therein and the minor diameter ends of the sleeves 48 are wedgingly received in those portions of the bores 36 immediately inwardly of the counterbores 38. The major diameter ends of the sleeves 48 project outwardly and beyond the opposite ends of the body 30 and include circumferential enlargements 50 thereon, compression springs 52 being disposed about the outer end portions of the sleeves 48 between the circumferential enlargements 50 thereof and the opposing end faces of the body 30, the springs 52 serving to yieldingly bias the sleeves 48 outwardly of positions with the inner minor diameter end portions thereof tightly wedged within those portions of the bores 36 immediately inwardly of the counterbores 38.

The end portions 38 of the body 30 are wrapped with heat insulative and handgrip affording strands 54 and the telescopingly engaged cup portions 40 and 42 are constructed of somewhat deformable material whereby they may be squeezed to clamp the tension member 26 between the exterior cylindrical surfaces of the center portion 34 of the body 30 and the inner surface portions of the cup 42.

In operation, a person desiring to use the fire escape 18 may apply the loop 28 over the hook 16 or utilize a fire resistant short anchor member for anchoring the tension member 26 within the upper floor room of the building 10 from which escape is desired. Thereafter, with the canister 20 removably supported from the seat sling 46 and the body 30 disposed outwardly of the window 12, the person utilizing the fire escape 18 places himself in the seat sling 46 and may actuate the lower sleeve 48 to control the descent of the body 30 downwardly along the tension member 26. Additionally, the cup portions 40 and 42 may be squeezed in one hand in order to clampingly engage the tension member 26 between the interior surfaces of the cup 42 and the exterior cylindrical surfaces of the center body portion 34, the upper sleeve 48 being retained in an inactive position by means of the attendant spring 52.

After the user of the escape 18 has reached ground level, the canister 20 may be removed from the seat sling 46 and a loop 54 may be tied in the tension member 26 below the body 30. Thereafter, the next person in window 12 to use the fire escape may pull up on the tension member 26 so as to again elevate the body 30 to the level of the window 12. Then, the loop 54 is hooked over the hook 16 and the loop 28 is disengaged from the hook 16 in order that the tension member 26 and the body 30 may be inverted. Thereafter, the second person to use the escape 18 operates the latter in substantially the same manner as the first person.

The tension member 26 may be of any desirable construction such as centrally reinforced with wire or cable and it will be noted that the attachment of the seat sling 46 to the body 30 is such to enable the body 30 to be operated in inverted position with the seat sling 46 depending downwardly from the body 30, the opposite ends of the seat sling 46 being pivotally attached to the body 30 by means of the fasteners 44. Further, a pair of diametrically opposite nylon cord sections 60 are secured between each enlargement 50 and the adjacent end portion 32 whereby full withdrawal of the sleeves 48 from the end portions 32 is prevented.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An apparatus for use in descending from high elevations, said apparatus including an elongated flexible tension member having a first end for anchoring to a suitable support structure at said high elevation and a free end portion which may depend downwardly to a lower elevation, a slide member guidingly engaged with said tension member for guided movement therealong, said slide member including readily actuatable and deactivatable friction brake and clamping means operative to selectively and variably frictionally brake and clamp said tension member for controlling the descent of said slide member downwardly along said tension member, said slide member being elongated and extending lengthwise along said tension member, said brake and clamping means including a pair of selectively and variably actuatable friction brake and clamp structures carried by opposite end portions of said slide member, the opposite ends of said slide member including endwise outwardly opening bores through which said tension member is slidably received, each of said brake and clamping means including a collet sleeve through which said tension member is snugly slidably received, said sleeves and bores including opposing cam surfaces functioning to radially inwardly displace the inner end portions of said sleeves in response to said sleeves being inwardly displaced into predetermined inner positions within said bores and to thereby cause the inner end portions of said collet sleeves to tightly clamp and frictionally brake said tension member and sleeves against relative longitudinal shifting.

2. The combinations of claim combination including spring means operatively associated with said collet sleeves and the corresponding end of said slide member operative to yieldingly bias said collet sleeves to outer positions spaced outwardly of said inner positions.

3. The combination of claim 1 wherein said slide member includes a diametrically enlarged central portion intermediate its opposite ends, the inner ends of said bores curving outwardly and in opposite directions about the center axis of said slide member and opening outwardly through axially spaced adjacent portions of said central portion, the portion of said tension member extending between the inner ends of said bores extending at least one full turn about said central portion.

4. The combination of claim 3 including a generally cylindrical cover structure enclosing said central portion of said slide member and constructed of shape retentive, resilient and somewhat deformable material and manually inwardly collapsible to clamp the last-mentioned portion of said tension member between the inner and outer surfaces of said cover and central portion of said slide member, respectively.

5. An apparatus for use in descending from high elevations, said apparatus including an elongated flexible tension member having a first end for anchoring to a suitable support structure at said high elevation and a free end portion which may depend downwardly to a lower elevation, a slide member guidingly engaged with said tension member for guided movement therealong, said slide member including readily actuatable and deactivatable friction brake and clamping means operative to selectively and variably frictionally brake and clamp said tension member for controlling the descent of said slide member downwardly along said tension member, said slide member being elongated and extending lengthwise along said tension member, said brake and clamping means including a pair of selectively and variably actuatable friction brake and clamp structures carried by opposite end portions of said slide member, including anchor members carried by opposite side portions of said slide member centrally intermediate its opposite ends, the ends of an elongated sling type seat being supported from said anchor members, the opposite ends of said slide member including endwise outwardly opening bores through which said tension member is slidably received, each of said brake and clamp structures including a collet sleeve through which said tension member is snugly slidably received, said sleeves and bores including opposing cam surfaces functioning to radially inwardly displace the inner end portions of said sleeves in response to said sleeves being inwardly displaced into predetermined inner positions within said bores and to thereby cause the inner end portions of said collet sleeves to tightly clamp and frictionally brake said tension member and sleeve against relative longitudinal shifting.

6. The combination of claim 5 including spring means operatively associated with said collet sleeves and the corresponding end of said slide member operative to yieldingly bias said collet sleeves to outer positions spaced outwardly of said inner positions.

7. The combination of claim 5 wherein said slide member includes a diametrically enlarged central portion intermediate its opposite ends, the inner ends of said bores curving outwardly and in opposite directions about the center axis of said slide member and opening outwardly through axially spaced adjacent portions of said central portion, the portion of said tension member extending between the inner ends of said bores extending at least one full turn about said central portion.

8. The combination of claim 7 including a generally cylindrical cover structure enclosing said central portion of said slide member and constructed of shape retentive, resilient and somewhat deformable material and manually inwardly collapsible to clamp the last-mentioned portion of said tension member between the inner and outer surfaces of said cover and central portion of said slide members, respectively.

9. An apparatus for use in descending from high elevations, said apparatus including an elongated flexible tension member having a first end for anchoring to a suitable support structure at said high elevations and a free end portion which may depend downwardly to a lower elevation, an elongated slide member including opposite end endwise outwardly opening bores and a generally cylindrical longitudinal mid-portion, the inner ends of said bores opening laterally outwardly of longitudinally spaced portions of said mid-portion and in oppositely outwardly spiraling directions, said tension member being passed through said bores with the intermediate portion thereof extending between the inner ends of said bores wrapped about said mid-portion, a flexible heat insulative cover secured about said mid-portion enclosing and collapsible inwardly into engagement with said intermediate portion, the outer end of at least one of said bores being inwardly tapered, a collet sleeve disposed in the outer end of said one bore and snugly slidably receiving the corresponding portion of said tension member therethrough, said collet sleeve and slide member including coacting means limiting an outward displacement of said collet sleeve relative to said one bore as well as inward displacement of said collet sleeve relative to said one bore, said collet sleeve, when displaced inwardly to its limit position relative to said slide member being reduced in internal dimensions so as to tightly frictionally engage the corresponding portion of said tension member.

10. The combination of claim 9 including spring means operatively connected between said slide member and said collet sleeve yieldingly biasing the latter toward its outermost limit position.

* * * * *